US009650722B2

(12) United States Patent
Sugawara et al.

(10) Patent No.: US 9,650,722 B2
(45) Date of Patent: May 16, 2017

(54) CHROME-PLATED PART AND MANUFACTURING METHOD OF THE SAME

(71) Applicants: NISSAN MOTOR CO., LTD., Yokohama-shi, Kanagawa (JP); ATOTECH DEUTSCHLAND GMBH, Berlin (DE)

(72) Inventors: Soichiro Sugawara, Zama (JP); Hiroaki Koyasu, Yokosuka (JP); Hiroshi Sakai, Sagamihara (JP); Jens-Eric Geissler, Berlin (DE); Grant Keers, Fort Mill, SC (US)

(73) Assignees: NISSAN MOTOR CO., LTD., Yokohama-shi (JP); ATOTECH DEUTSCHLAND GMBH, Berlin (DE)

( * ) Notice: Subject to any disclaimer, the term of this patent is extended or adjusted under 35 U.S.C. 154(b) by 0 days.

(21) Appl. No.: 14/294,881

(22) Filed: Jun. 3, 2014

(65) Prior Publication Data

US 2014/0284218 A1 Sep. 25, 2014

Related U.S. Application Data

(62) Division of application No. 12/675,002, filed as application No. PCT/JP2008/002327 on Aug. 27, 2008, now abandoned.

(30) Foreign Application Priority Data

Aug. 30, 2007 (JP) ..... 2007-223954
Jul. 8, 2008 (JP) ..... 2008-177529

(51) Int. Cl.
*C23C 28/00* (2006.01)
*C23C 28/02* (2006.01)
(Continued)

(52) U.S. Cl.
CPC ..... *C25D 11/38* (2013.01); *C25D 3/06* (2013.01); *C25D 3/10* (2013.01); *C25D 5/14* (2013.01);
(Continued)

(58) Field of Classification Search
CPC ..... C23C 28/00; C23C 28/30; C23C 28/32
(Continued)

(56) References Cited

U.S. PATENT DOCUMENTS 2,990,343 A * 6/1961 Safranek ..... C25D 3/56 205/243
3,761,363 A * 9/1973 Tremmel ..... 205/109
(Continued)

FOREIGN PATENT DOCUMENTS

GB 2 136 020 A 9/1984
JP 51-084744 7/1976
(Continued)

OTHER PUBLICATIONS

Tremmel, "Methods to Improve the Corrosion Performance of Microporous Nickel Deposits," Plating & Surface Finishing (Oct. 1996), pp. 24-28.*
(Continued)

*Primary Examiner* — Edna Wong
(74) *Attorney, Agent, or Firm* — Foley & Lardner LLP

(57) ABSTRACT

An nickel plating layer (5*a*) intended for corrosion current distribution is formed over a body (2), and a 0.05 to 2.5 micrometers thick surface chrome plating layer (6) made of trivalent chromium is formed on the surface thereof using basic chromium sulfate as a source of metal. Further on the same, a not less than 7 nm thick chromium compound film (7) is formed by cathode acidic electrolytic chromatin. The corrosion distribution nickel plating layer (5*a*) has a function of forming a microporous structure, a microcrack structure,
(Continued)

or the both of the same in the surface chrome plating layer (6).

7 Claims, 4 Drawing Sheets

(51) Int. Cl.

| | |
|---|---|
| ***C25D 11/38*** | (2006.01) |
| ***C25D 3/06*** | (2006.01) |
| ***C25D 5/14*** | (2006.01) |
| ***C25D 5/34*** | (2006.01) |
| ***C25D 3/10*** | (2006.01) |
| ***C25D 5/40*** | (2006.01) |

(52) U.S. Cl.
CPC ..... *C25D 5/34* (2013.01); *C25D 5/40* (2013.01); *Y10T 428/12472* (2015.01); *Y10T 428/12847* (2015.01)

(58) Field of Classification Search
USPC ..... 205/183, 184, 188
See application file for complete search history.

(56) References Cited

U.S. PATENT DOCUMENTS

| | | | | | |
|---|---|---|---|---|---|
| 3,954,574 | A * | 5/1976 | Gyllenspetz | C25D 3/06 | 205/243 |
| 4,543,167 | A | 9/1985 | Seyb et al. | | |
| 4,617,095 | A * | 10/1986 | Tomaszewski | C25D 11/38 | 205/179 |
| 4,875,983 | A | 10/1989 | Alota et al. | | |
| 4,898,649 | A * | 2/1990 | Iwasa | C25D 11/38 | 205/111 |
| 4,960,653 | A * | 10/1990 | Yokoi | C25D 5/14 | 205/109 |
| 6,426,146 | B1 * | 7/2002 | Ameen | C23C 26/00 | 205/197 |
| 6,468,672 | B1 * | 10/2002 | Donovan, III | C25D 5/14 | 205/169 |
| 2004/0194859 | A1 | 10/2004 | Asou et al. | | |
| 2006/0026952 | A1 | 2/2006 | Takahashi | | |
| 2011/0117380 | A1 | 5/2011 | Sugawara et al. | | |

FOREIGN PATENT DOCUMENTS

| | | | | |
|---|---|---|---|---|
| JP | 58-153795 | A | 9/1983 | |
| JP | 62-263993 | A | 11/1987 | |
| JP | 01-298191 | A | 12/1989 | |
| JP | 03-291395 | A | 12/1991 | |
| JP | 05171468 | A * | 7/1993 | C23C 28/02 |
| JP | 2005-232529 | A | 9/2005 | |
| JP | 2006-070894 | A | 3/2006 | |
| JP | 2007-039770 | A | 2/2007 | |
| JP | 2007-056282 | A | 3/2007 | |
| JP | 2009-074168 | A | 4/2009 | |

OTHER PUBLICATIONS

K. Watanabe, "Decorative Trivalent Chromium Plating", Surface Technology, vol. 56, No. 6, 2005, pp. 20-24.

Lin Xia et al, Chemistry of a Chromate Conversion Coating on Aluminum Alloy AA2024-T3 Probed by Vibrational Spectroscopy, J. Electrochem. Soc., vol. 145, No. 9, Sep. 1998, pp. 3083-3089.

* cited by examiner

CHROME-PLATED PART AND MANUFACTURING METHOD OF THE SAME

CROSS REFERENCE TO RELATED APPLICATIONS

This application is a divisional of U.S. application Ser. No. 12/675,002, filed Feb. 24, 2010, now abandoned, which is the National Stage of Application No. PCT/JP2008/002327, filed Aug. 27, 2008, which claims benefit of priority from the prior Japanese Application No. 2007-223954, filed Aug. 30, 2007 and Japanese Application No. 2008-177529, filed Jul. 8, 2008; the entire contents of all of which are incorporated herein by reference.

TECHNICAL FIELD

The present invention relates to a chrome-plated part represented by a decorative part such as an emblem or a front grill of an automobile and a method of manufacturing the same. More specifically, the present invention relates to a chrome-plated part having high resistance to corrosion and providing a white silver design similar or equivalent to hexavalent chromium plating.

BACKGROUND ART

As is well known, for example, automobile exterior parts or exterior design parts such as decorative parts including, for example, emblems, front grills (radiator grills), and door handles of automobiles are subjected to decorative chrome plating for purposes of improving aesthetic appearance, increasing surface hardness to prevent scratch, and furthermore providing corrosion resistance to prevent rust.

More specifically, in a decorative chrome-plated part having a body made of metal or a resin material such as ABS, the body is sequentially subjected to copper plating, non-sulfur nickel plating, bright nickel plating, and corrosion distribution nickel plating as surface preparation for chrome plating, and then chrome plating is performed for the corrosion distribution nickel plating layer by a hexavalent or trivalent chromium plating bath. On the hexavalent chrome plating layer, a passive film is formed by a wet oxidation treatment such as an anodic electrolytic oxidation, thus obtaining a composite film layer structure (Patent Citation 1). These are intended for a multilayer structure which prevents corrosion for an increase in corrosion resistance and are described as follows.

In other words, the chrome plating layer in the surface constitutes a composite structure together with the underlying nickel plating layer, and the nickel plating layer constitutes a composite structure together with the non-sulfur nickel plating layer, bright nickel plating layer, and corrosion distribution nickel plating layer to distribute corrosion current for an increase in corrosion resistance. Furthermore, the corrosion distribution nickel plating is microporous nickel plating or microcrack nickel plating which generates microcracks by high stress. By action of these types of corrosion distribution nickel plating, the chrome plating layer in the surface includes fine pores (microporous) or fine cracks (microcracks). A number of the micropores or microcracks cause corrosion current to be distributed, thus preventing local corrosion of the underlying bright nickel plating layer. This results in an increase in corrosion resistance.

The total thickness of all of the plating layers of the aforementioned composite film layer structure except the chrome plating layer in the surface is about 5 to 100 micrometers, and the top-most chrome plating layer necessary for keeping the aesthetic appearance is resistant to corrosion. Accordingly, the composite film layer structure can give a decorative chrome-plated part with a design exploiting the advantage of white silver color of the chrome plating layer over long periods.

Moreover, the long employed hexavalent chromium plating is excellent in white metal bright appearance. However, hexavalent chrome is being subject to strict environmental restrictions in recent years, and Non Patent Citation 1 discloses as a decorative trivalent chromium plating technique replaced for the hexavalent chromium plating, TriChrome Plus process, TriChrome Light process, and TriChrome Smoke process using a single cell-type trivalent bath and in addition an envirochrome process and a twilight process using a double cell-type trivalent bath.

[Patent Citation 1]

Japanese Patent Laid-open No. 2005-232529 Publication

[Non Patent Citation 1]

"Surface Technology", the Surface Finishing Society of Japan, Vol. 56, No. 6, 2005, P 20-24

DISCLOSURE OF INVENTION

Technical Problem

However, as a premise of the technique described in Patent Citation 1, for example, a posttreatment by cathode electrolytic chromating capable of being carried out easily for a short time cannot be expected to provide an effect on increasing the resistance to chrome dissolving corrosion.

Moreover, in the decorative trivalent chromium plating techniques of the technique described in the latter Non Patent Citation 1, every process is inferior to the hexavalent chromium plating in terms of the corrosion resistance and is difficult to apply especially to a part requiring high corrosion resistance such as automobile exterior parts.

More specifically, the Trichrome Plus process is significantly inferior to hexavalent chromium plating in terms of the resistance to microporous corrosion. The Envirochrome process is inferior to the hexavalent chromium plating in terms of the resistance to microporous corrosion and the resistance to chrome dissolving corrosion. In addition, the Envirochrome process has a disadvantage that the plating thickness cannot be expected to increase while the plating bath is not carefully controlled even if the plating thickness is intended to increase for purposes of increasing the corrosion resistance. Furthermore, the twilight process cannot be used in the case where the white-silver color similar to hexavalent chromium plating is demanded for convenience of design because the chromium plating film itself is dark-tone color.

The present invention was made in the light of such problems, and an object of the present invention is to provide a chrome-plated part having a white-silver design similar or equivalent to that in the case of hexavalent chromium plating and provides a manufacturing method of the same.

Technical Solution

A chrome-plated part according to the present invention includes: a body; a corrosion distribution plating layer formed over the body; a 0.05 to 2.5 micrometers thick trivalent chromium plating layer formed on the corrosion distribution plating layer using basic chromium sulfate as a metal source; and a not less than 7 nm thick chromium compound film formed on the trivalent chromium plating layer on cathode acidic electrolytic chromating.

A method of manufacturing a chrome-plated part according to the present invention includes the steps of: forming a corrosion distribution plating layer intended for corrosion current distribution over a body; forming a 0.05 to 2.5 micrometers thick trivalent chromium plating layer on the corrosion distribution plating layer using basic chromium sulfate as a metal source; and forming a not less than 7 nm thick chromium compound film on the trivalent chromium plating layer by cathode acidic electrolytic chromating.

Advantageous Effects

According to the present invention, it is possible to obtain a plated part having high corrosion resistance and providing a white-silver color design similar or equivalent to hexavalent chromium plating.

EXPLANATION OF REFERENCE

Figure 1:
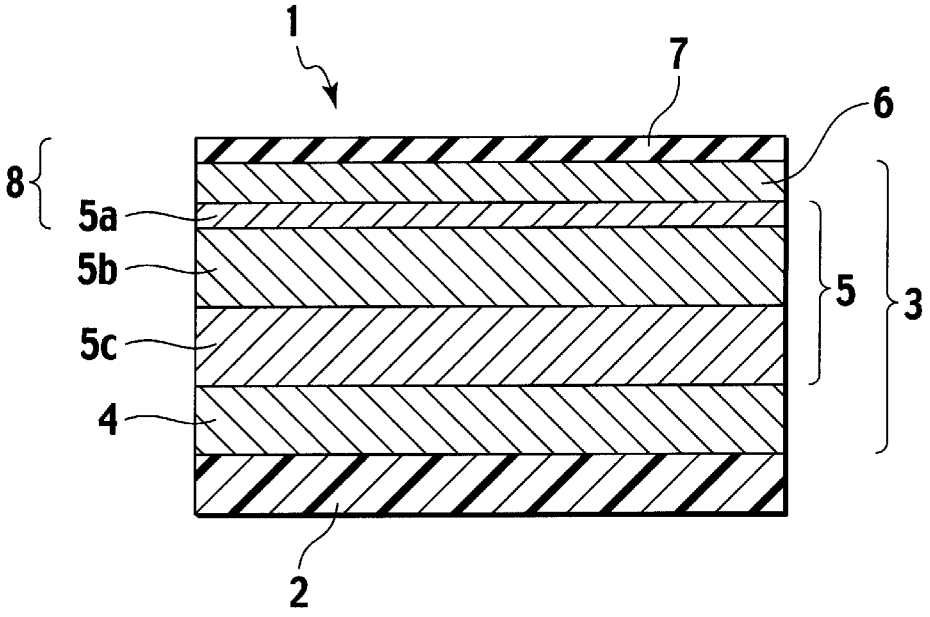
FIG. 1 is an enlarged cross-sectional explanatory view of a surface portion of a decorative chrome-plated part, illustrating a preferred embodiment of the present invention.

1 . . . DECORATIVE CHROME-PLATED PART
2 . . . BODY
3 . . . ALL PLATING LAYER
4 . . . COPPER PLATING LAYER
5 . . . NICKEL PLATING LAYER
5A . . . CORROSION DISTRIBUTION NICKEL PLATING LAYER
5B . . . BRIGHT NICKEL PLATING LAYER
5C . . . NON-SULFUR NICKEL PLATING LAYER
6 . . . SURFACE CHROME PLATING LAYER (TRIVALENT CHROMIUM PLATING LAYER)
7 . . . CHROMIUM COMPOUND FILM
8 . . . COMPOSITE PLATING FILM

BEST MODE FOR CARRYING OUT THE INVENTION

As described above, a chrome-plated part of the present invention includes: a body; a corrosion distribution plating layer formed over the body; a 0.05 to 2.5 micrometers thick trivalent chromium plating layer formed on the corrosion distribution plating layer using basic chromium sulfate as a source of metal; and a not less than 7 nm thick chromium compound film formed on the trivalent chromium plating layer by cathode acid electrolyte chromating. The corrosion distribution plating layer and trivalent chromium plating layer are included in an all plating layer which is formed on the surface of the body and composed of a plurality of metallic plating layers.

The aforementioned trivalent chromium plating layer has a microporous structure or a microcrack structure desirably both of the microporous and microcrack structures. This is advantageous in the case where the corrosion distribution plating layer combined with the trivalent chromium plating layer has a function of actively forming the microporous or microcrack structure in the trivalent chromium plating layer. This is because the combination with the microporous or microcrack structure naturally provided with the trivalent chromium plating film itself allows the size of the micropores to be further reduced to more finely distribute microporous corrosion.

A chrome-plated part for automobile exterior part and the like is required to have white silver design, excellent corrosion resistance for microporous corrosion and excellent corrosion resistance against calcium chloride. In order that the chrome-plated part is provided with a white silver design similar or equivalent to that formed by hexavalent chromium plating, excellent corrosion resistance for microporous corrosion and excellent corrosion resistance against calcium chloride, it is desirable that the composite plating film composed of the corrosion distribution plating layer, trivalent chromium plating layer, and chromium compound film satisfies the following all conditions (a) to (c):

(a) The 60 degree specular gloss is not less than 480.

(b) The evaluated value of the rating number is not less than 8.0 when CASS test specified in the above JIS H 8502 is carried out for 40 hours and then evaluation based on an entire corrosion area ratio is carried out according to JIS H 8502 for corrosion spots not smaller than 30 micrometers.

(c) No changes in appearance by corrosion are observed after a corrosion test in which a muddy corrosion accelerator including a mixture of 30 g of kaolin and 50 ml of calcium chloride saturated solution is uniformly applied to the composite plating film and the chrome-plated part is left for 336 hours in a constant temperature and humidity chamber maintained at an environment of 60 degrees and 23% RH.

For the aforementioned reason, the above corrosion distribution plating layer is a plating layer having a function of forming the microporous or microcrack structure in the trivalent chromium plating layer combined with the corrosion distribution plating layer and is more desirably a plating layer having a function of providing both the microporous and microcrack structures.

Desirably, the trivalent chromium plating layer is produced by electroplating in a plating bath containing as a main component 90 to 160 g/l basic chromium sulfate and containing as additives of at least one of thiocyanate, monocarboxylate, and dicarboxylate, at least one of ammonium salt, alkali metal salt, and alkaline earth metal salt, a boron compound, and a bromide.

The additive represented by the thiocyanate, monocarboxylate, and dicarbocylate functions as a bath stabilization complexing agent allowing the plating to be stably continued. The additive represented by ammonium salt, alkali metal salt, and alkaline earth metal salt functions as an electricity-conducting salt allowing electricity to easily flow through the plating bath to increase plating efficiency. Furthermore, the boron compound as the additive functions as a pH buffer controlling pH fluctuations in the plating bath, and the bromide has a function of suppressing generation of chlorine gas and production of hexavalent chromium on the anode.

More desirably, the above trivalent chromium plating layer is produced by electroplating in a plating bath containing as additives: at least one of ammonium formate and potassium formate as the monocarboxylate; at least one of ammonium bromide and potassium bromide as the bromide, and boric acid as the boron compound.

More specifically, the above trivalent chromium plating layer is a trivalent chromium plating film with a thickness of 0.15 to 0.5 micrometers which is treated and produced by electroplating, for example, under the conditions that the plating bath contains 130 g/l of the basic chromium sulfate and about 40 g/l of ammonium formate or about 55 g/l of potassium formate and the current density of electroplating is about 10 $A/m^2$.

The chromium compound film of the chrome-plated part is composed of at least one of chrome oxide, hydroxide, and oxyhydroxide produced by cathode acidic electrolytic chromating in a treatment bath containing Cr (VI) and has a thickness of not less than 7 nm. It is desirable that an amount of hexavalent chromium eluted from the chromium compound film boiled for 10 minutes is less than 0.006 microgram per square centimeter.

Furthermore, the chromium compound film of the chrome-plated part is a film with a thickness of not less than 7 nm which is produced by cathode acidic electrolytic chromating for 10 to 90 sec, at a current density of 0.1 to 1.0 $A/dm^2$ in a bath with a pH of 1.0 to 5.5 at a temperature of 20 to 70° C., the bath containing at least 20 to 40 g/l of any one of bichromate, chromate, and chromic anhydride. Desirably, the chromium compound film is a film composed of at least one of an oxide, hydroxide, and oxyhydroxide.

More desirably, the chromium compound film is a chromium compound film produced in a bath with a pH of 4.0 to 5.0 at a temperature of about 35° C., the bath containing about 27 g/l of sodium dichromate dihydrate.

Next, a description is given of a manufacturing method.

A method of manufacturing the chrome-plated part of the present invention includes the steps of: forming the corrosion distribution plating layer over a body for purposes of distribution of corrosion current; forming a 0.05 to 2.5 micrometers thick trivalent chromium plating layer on the corrosion distribution plating layer using basic chromium sulfate as a source of metal; and forming a film of chromium compound with a thickness of not less than 7 nm on the trivalent chromium plating layer by cathode acid electrolytic chromating.

Desirably, the method of manufacturing the chrome-plated part includes enough water washing steps among the aforementioned steps. Furthermore, in order to prevent an oxide film inhibiting deposition in the plating surface from being produced in the plating surface, it is desirable that the intervals between the processing steps are set short enough that the surface does not dry.

In the above manufacturing method, desirably, the corrosion distribution plating layer is produced by electroplating in a plating bath having a function of providing the microporous structure, the microcrack structure, or the both microporous and microcrack structures.

Furthermore, in the manufacturing method, desirably, the trivalent chromium plating layer is produced by electroplating in a plating bath containing: 90 to 160 g/l of basic chromium sulfate as a main component; and as additives, at least one of thiocyanate, monocarboxylate, dicarboxylate functioning as a bath stabilization complexing agent among the additives stably maintaining the plating; at least one of ammonium salt, alkali metal salt, and alkali earth metal salt functioning as a conductive salt to allow the plating bath to easily conduct electricity for an increase in plating efficiency; a boron compound functioning as a pH buffer reducing pH fluctuations in the plating; and bromide added for purposes of suppressing generation of chlorine gas and production of hexavalent chromium on the anode.

More desirably, the plating bath contains as the additives: at least one of ammonium formate and ammonium potassium for example as the monocarboxylic acid salt functioning as the bath stabilization complexing agent; at least one of ammonium bromide and potassium bromide as the bromide, for example; and boric acid as the boron compound functioning as the pH buffer.

More specifically, the cathode acidic electrolytic chromating is performed and controlled under conditions that the bath contains 130 g/l of chromium sulfate in the bath 130 g/l; and the about 40 g/l of ammonium formate or about 55 g/l of potassium formate and that the current density of electroplating is about 10 A/dm2 so that the produced film has a thickness of 0.15 to 0.5 micrometers.

Furthermore, in the aforementioned manufacturing method, desirably, the cathode acidic electrolytic chromating is controlled and performed at a current density of 0.1 to 1.0 $A/dm^2$ for 10 to 90 seconds in the bath with a pH of 1.0 to 5.5 at a temperature of 20 to 70° C., the bath containing 20 to 40 g/l of at least one of bichromate, chromate, and chromic anhydride in total.

More desirably, the cathode acidic electrolytic chromating is performed with 2.7 g/l of sodium dichromate dihydrate as chromate salt at a pH of 4.0 to 5.0 at a bath temperature of 35° C.

FIG. 1 is a view illustrating a more specific example of the present invention, showing an enlarged cross-sectional view of an automobile exterior part as a decorative chrome-plated part.

The decorative chrome-plated part 1 shown in the same drawing as an example includes an ABS resin molded product as a body 2. On a surface of the body 2, an all plating layer 3 composed of a plurality of metallic plating layers is formed. The all plating layer 3 is covered with a chromium compound film 7.

More specifically, on the surface of the body 2 which is an ABS resin molded product, a copper plating layer 4 serving as a base is formed for purposes of increasing smoothness thereof or the like. On the copper plating layer 4, an nickel plating layer 5 is formed. Furthermore, on the nickel plating layer 5, a trivalent chromium plating layer is formed as a surface chrome plating layer 6. These copper plating layer 4, nickel plating layer 5, and surface chrome plating layer 6 constitute the all plating layer 3 with a composite structure. The all plating layer 3 covers the body 2 to provide a design exploiting the white silver color of the surface chrome plating layer 6. The thickness of the all plating layer 3 is generally about 5 to 100 micrometers.

Comparing the surface chrome plating layer 6 and nickel plating layer 5, the nickel plating layer 5 is more prone to electrochemical corrosion, and accordingly, the nickel plating layer 5 has a composite structure for purposes of increasing the corrosion resistance. Specifically, the nickel plating layer 5 has a three layer structure composed of a corrosion distribution nickel plating layer **5*a* which is intended for distribution of corrosion current and functions as a base of the surface chrome plating layer 6, a bright nickel plating layer 5*b* under the same, and a non-sulfur nickel plating layer 5*c* including traces of sulfur contained in the brightening agent of the bright nickel plating layer 5*b*, thus increasing the corrosion resistance. The corrosion distribution nickel plating layer 5*a* corresponds to a corrosion distribution plating layer of the present invention. The corrosion distribution nickel plating layer 5***a*, the surface chrome plating layer 6, and a chromium compound film 7 constitute a composite plating film 8.

The corrosion resistance of the nickel plating layer 5 is increased because comparing the bright nickel plating layer 5*b* and non-sulfur plating layer 5*c*, the non-sulfur nickel has a more noble potential. Because of such a potential difference, corrosion proceeds in the transverse direction of the bright nickel plating layer 5*b*, and progress of corrosion toward the non-sulfur nickel plating layer 5*c* or in the depth direction is suppressed. Accordingly, corrosion proceeds towards the non-sulfur nickel plating layer 5*c* and copper plating layer 4, thus increasing time until corrosion appears as defective appearances such as exfoliation of the plating layers. Moreover, in order to suppress local corrosion of the underlying bright nickel plating layer 5*b*, the surface chrome plating layer 6 includes a number of fine pores (microporous) or fine cracks (microcracks) in the surface thereof. The existence of these number of micropores or microcracks allows corrosion current to be distributed and suppresses the local corrosion in the bright nickel plating layer 5*b*, thus increasing the corrosion resistance. The micropores and microcracks in the surface chrome plating layer 6 is produced by the corrosion distribution nickel plating layer 5*a* intended for corrosion current distribution.

Herein, the body 2 is not necessarily limited to a resin material represented by ABS resin. The body 2 should be made of a material capable of being decorative chrome plated, and it makes no difference if the body 2 is made of resin or metal. In the case of a resin material, electroplating can be performed by giving conductivity to the surface by means of electroless plating, direct process, or the like.

The copper plating layer 4 in the all plating layer 3 is not necessarily limited to a copper layer. Generally, copper plating is formed on the body 2 for purposes of the aforementioned increase in smoothness, reduction of the difference between linear expansion coefficients of the body 2 and nickel plating layer 5, and the like. However, instead of copper plating, it is possible to employ, for example, nickel plating or tin-copper alloy plating capable of exerting similar effects.

Furthermore, the nickel plating layer 5 in the all plating layer 3 is not necessarily a nickel layer. The effects on increasing the resistance to microporous corrosion can be expected for not only nickel plating but also the previously mentioned tin-copper alloy plating. Accordingly, the tin-copper alloy plating can be employed instead of the nickel plating. In this case, it is also necessary to provide the corrosion distribution plating layer.

In addition, trinickel plating is provided between the bright nickel plating layer 5*b* and non-sulfur nickel plating layer 5*c* in some cases for purposes of preventing progress of corrosion to the non-sulfur nickel plating layer 5*c*. The present invention can be applied also to such a case.

The corrosion distribution nickel plating layer 5*a* intended for corrosion current distribution of the decorative chrome-plated part 1 is preferably plating which forms the microporous or microcrack structure in the surface chrome plating layer 6 and more preferably, plating which forms the microporous structure. This is because in the case of plating forming the microcrack structure, the surface chrome plating layer 6 provided on the same tends to be thin particularly around a portion distant from an counter electrode at electroplating in the entire part, thus leading to low corrosion resistance of the part in some cases.

When the above described defects caused at plating are surely avoided, it is particularly preferable that the corrosion distribution nickel plating layer 5*a* is formed by plating forming the both microporous and microcrack structures in the surface chrome plating layer 6 which is a trivalent chromium plating layer. This is because if the corrosion distribution nickel plating layer 5*a* is provided with the function of forming the both microporous and microcrack structures in the surface chrome plating layer 6, the combination with the microporous structure naturally included in the surface chrome plating layer 6 (trivalent chromium plating film) itself allows the micropores to be further miniaturized. This allows the microporous corrosion to be more finely distributed.

The thickness of the surface chrome plating layer 6 of the decorative chrome-plated part 1 represented by an automobile exterior part is desirably 0.05 to 2.5 micrometers and more desirably 0.15 to 0.5 micrometers. In the case where the thickness is less than 0.05 micrometers, it is sometimes difficult to secure the design as the aesthetic appearance of the part and the plating corrosion resistance. In the surface chrome plating layer 6 with a thickness of more than 2.5 micrometers, cracks are caused by stress in a portion of the part, thus sometimes reducing the corrosion resistance. As the method of forming the surface chrome plating layer 6, so-called electroplating is optimal, but chrome-alloy plating can be employed.

The topmost chromium compound film 7 in the surface chrome plating layer 6 of the decorative chrome-plated part 1 is desirably a not less than 7 nm thick film formed by cathode electrolytic chromating. The chromium compound film 7 with a thickness of less than 7 nm makes it difficult to secure the corrosion resistance of the chrome plated part in some cases. In the present invention, the thickness of the chrome compound is defined as a sputter depth where the concentration of oxygen is half the maximum at an elemental analysis from the surface of the decorative chrome-plated part in the depth direction (depth profiling) from the surface of the decorative chrome-plated part by a X-ray photoelectron spectroscopy (XPS).

In the aforementioned manufacturing method of the decorative chrome-plated part 1, the concentration of the basic chromium sulfate is desirably 90 to 160 g/l. When the concentration thereof is less than 90 g/l, the deposition of the surface chrome plating layer 6 is degraded, and the surface chrome plating layer 6 becomes too thin, thus sometimes making it difficult to secure the aesthetic design of the part and the plating corrosion resistance. On the other hand, when the concentration thereof exceeds 160 g/l, the stability of the bath is degraded, and some components can be precipitated.

In the cathode acidic electrolytic chromating in the manufacturing method of the aforementioned decorative chrome-plated part 1, the bath desirably contains at least 20 to 40 g/l of at least any one of bichromate, chromate, and chromic anhydride. When the concentration thereof is less than 20 g/l, the aforementioned treatment has a degrading effect, and sufficient corrosion resistance cannot be obtained sometimes. On the other hand, when the concentration thereof exceeds 40 g/l, the surface of the part can be tarnished.

Desirably, the treatment bath has a pH of 1.0 to 5.5. With the treatment bath with a pH of less than 1.0, the part can tarnish to brown color. On the other hand, with the treatment bath with a pH of more than 5.5, enough corrosion resistance cannot be obtained in some cases.

Moreover, the temperature of the treatment bath is desirably 20 to 70° C. When the temperature thereof is less than 20° C., the reaction speed at the surface of the surface chrome plating layer 6 is low, and enough corrosion resistance cannot be obtained in some cases. On the other hand, when the temperature thereof is more than 70° C., the reaction speed is too high, and the film is produced ununiformly, thus sometimes causing tarnish to brown color in the part.

Furthermore, the current density is desirably 0.1 to 1.0 $A/dm^2$. When the current density is less than 0.1 $A/dm^2$, the chrome compound does not precipitate enough, and necessary and sufficient corrosion resistance cannot be obtained. On the other hand, when the current density is more than 1.0 $A/dm^2$, the reaction speed is too high, and the film is produced ununiformly, thus sometimes causing tarnish to brown color in the part.

The treatment time is desirably 10 to 90 seconds. With the treatment for less than 10 seconds, the treatment time is too short to sufficiently produce the chromium compound film 7, and sufficient corrosion resistance cannot be obtained in some cases. On the other hand, with the treatment for more than 90 seconds, the film is produced ununiformly, thus sometimes causing tarnish to brown color in the part.

Still furthermore, it is desirably to carry out the treatment using sodium bichromate dihydrate as a chromate-type salt with a concentration of about 27 g/l at a pH of 4.0 to 5.0 at a bath temperature of about 35° C. A film produced under such conditions has least variation in the corrosion resistance and can be stably treated.

Figure 2:
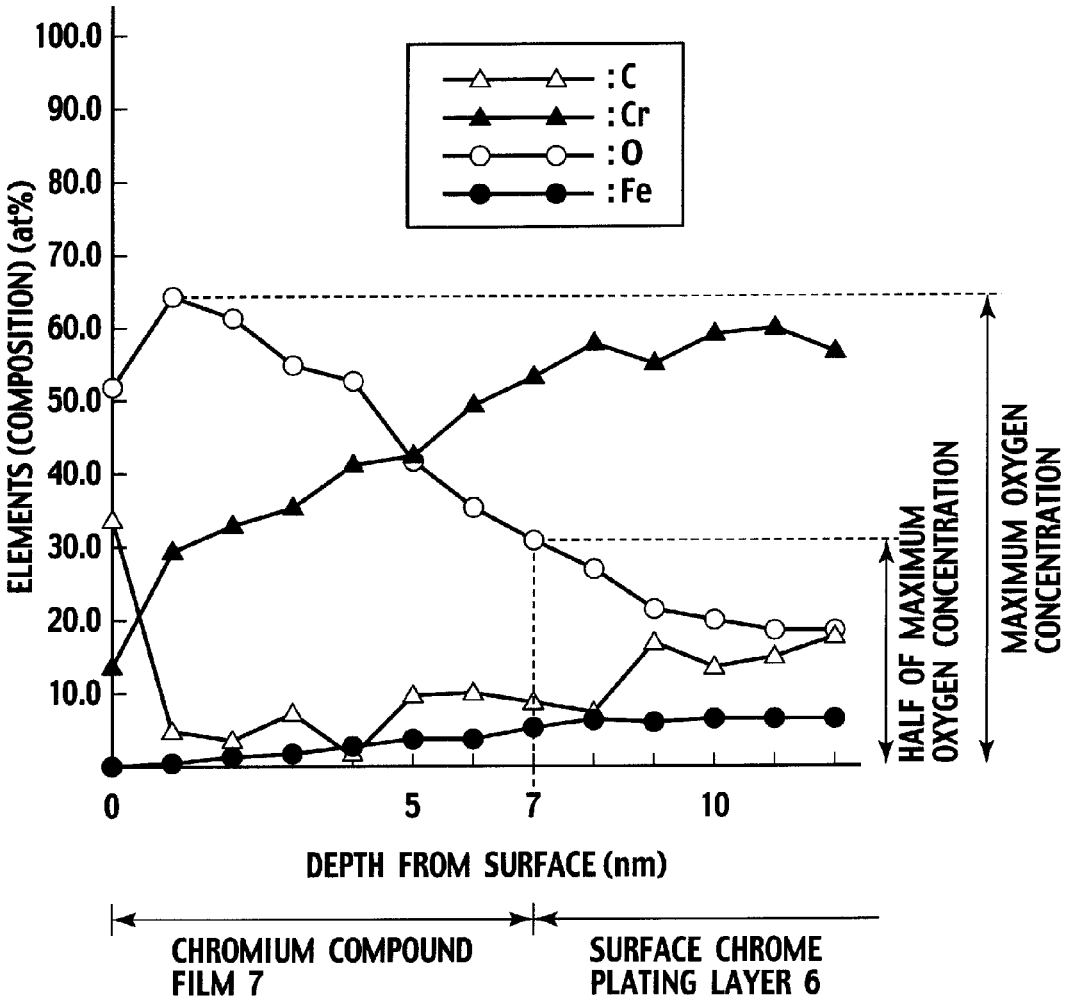
FIG. 2 is a view showing results of XPS spectrum analysis in the surface portion of the same decorative chrome-plated part.

FIG. 2 shows results of an XPS spectrum analysis from the surface of the aforementioned decorative chrome-plated part 1 in the depth direction. In the same drawing, the depth where the concentration of oxygen is half of the maximum, which is 7 nm, is a thickness of the chromium compound film 7. The region below the depth of 7 nm is the surface chrome plating layer 6. As is apparent from the same drawing, the surface chrome plating layer 6 has a tendency that the composition of the elements (at %) is stabilized especially in a region below the depth of 9 nm from the surface. However, according to the inventor's consideration, it was revealed that expected performances could be obtained as described later when the surface chrome plating layer 6 has Fe (iron), preferably 1 to 7 at % of Fe, more preferably a composition of 3 to 19 at % of C (carbon), 1 to 22 at % of O (oxygen), and 1 to 7 at % of Fe (iron) (the rest is Cr (chrome) and impurities). In other words, it was revealed that such a composition could provide excellent corrosion resistance and white-silver design similar or equivalent to the hexavalent chromium plating due to the chromium compound film 7.

MODE FOR THE INVENTION

Test pieces as samples of the decorative chrome plated-part of the present invention were prepared as Examples 1 to 28, and test pieces for comparison with Examples 1 to 28 were prepared as Comparative Examples 1 to 22. The test pieces of Examples 1 to 28 and Comparative Examples 1 to 22 were individually prepared by the following way.

The body of each test piece of Examples 1 to 28 and Comparative Examples 1 to 22 was a resin substrate roughly having a size of a business card (herein, the material thereof was ABS resin, for example). Every test piece was subjected to the plating treatments after the pretreatment in order of copper plating, non-sulfur nickel plating, and bright nickel plating. The major difference exists at the plating treatment intended for corrosion current distribution and thereafter. Accordingly, each of the test pieces of Examples 1 to 28 and Comparative Examples 1 to 22 was prepared by a combination of one of the plating treatments intended for corrosion current distribution shown in Table 1 below, one of the chrome plating treatments shown in Table 2 below, and one of the cathode electrolytic chromating treatments shown in Table 3 below.

Table 1 corresponds to Examples 1 to 5, showing results of later-described corrosion test 1, corrosion test 2, and evaluations of specular gloss and appearance for different conditions of the plating treatment intended for corrosion current distribution. Table 2 corresponds to Examples 6 to 14, showing results of the later-described corrosion tests 1 and 2 and evaluations of specular gloss and appearance for different conditions of the trivalent chromium plating using the basic chromium sulfate as the source of metal.

Table 3 corresponds to Examples 15 to 28, showing results of the later-described corrosion tests 1 and 2 and evaluations of specular gloss and appearance for different conditions of the cathode acidic electrolytic chromating for producing the chromium compound film 7. Table 4 corresponds to Comparative Examples 1 and 2, showing results of the later-described corrosion tests 1 and 2 and evaluations of specular gloss and appearance for different conditions of the plating intended for corrosion current distribution.

Table 5 corresponds to Comparative Examples 3 to 6, showing results of the later-described corrosion tests 1 and 2 and evaluations of specular gloss and appearance for different conditions of the trivalent chromium plating using the basic chromium sulfate as the source of metal. Table 6 corresponds to Comparative Examples 7 to 18, showing results of the later-described corrosion tests 1 and 2 and evaluations of specular gloss and appearance for different conditions of the cathode acidic electrolytic chromating for producing the chromium compound film 7.

Furthermore, Table 7 corresponds to Comparative Examples 19 to 22, showing results of the later-described corrosion tests 1 and 2 and evaluations of specular gloss and appearance for different types of chrome plating.

(1) Plating Intended for Corrosion Current Distribution

In the examples and comparative examples indicated by symbols (P) in Tables 1 to 7, the plating for producing the corrosion distribution nickel plating layer 5*a* intended for corrosion current distribution was carried out in a microporous nickel plating bath so that 5000/$cm^2$ or more of micropores were produced in the surface chrome plating layer 6.

In the examples and comparative examples indicated by symbols (Q), the plating was carried out in a microcrack nickel plating bath so that 250/$cm^2$ or more of cracks were produced in the surface chrome plating layer 6. The test pieces with "NOT EXECUTED" or "NONE" were not subjected to any plating treatment intended for corrosion current distribution.

On the other hand, in Examples and Comparative Examples indicated by symbols (R), the plating was carried out in a microporous nickel plating bath with powder dispersed in a microcrack nickel plating bath forming microcracks by high stress so that 1000/$cm^2$ or more of pores and 500/$cm^2$ of microcracks were produced in the surface chrome plating layer 6. The examples and comparative examples indicated by symbols (S) were subjected to the treatment so that microcracks were produced in the film itself due to the influence of the overlying chrome plating.

Figure 3:
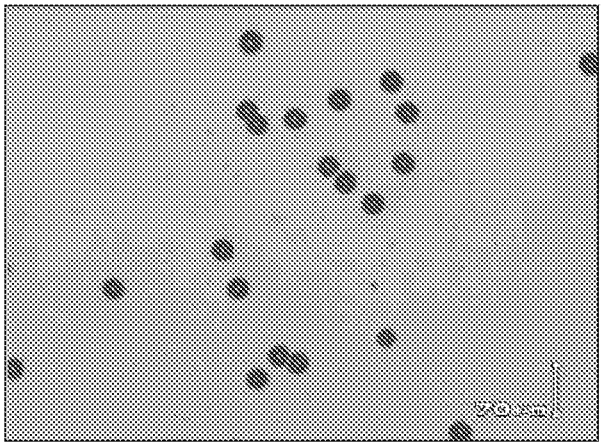
FIG. 3 is a micrograph of the surface chrome plating layer in which the microporouses are formed.
Figure 4:
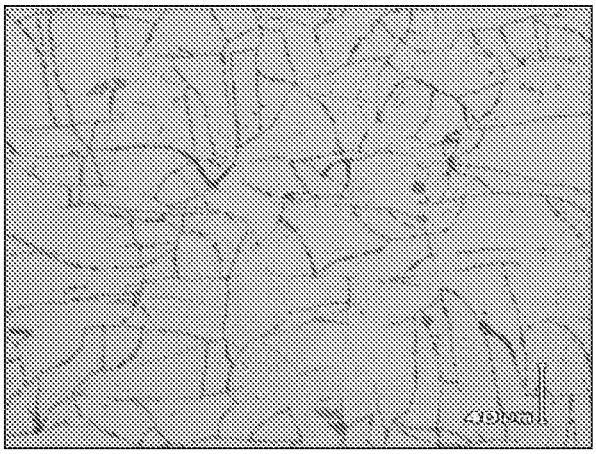
FIG. 4 is a micrograph of the surface chrome plating layer 6 in which microcracks are formed.
Figure 5:
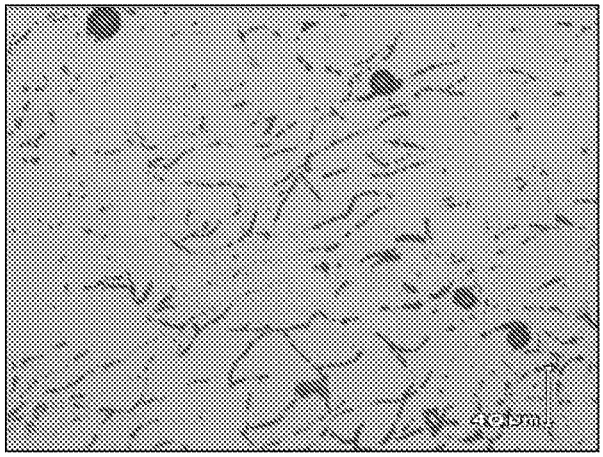
FIG. 5 is a micrograph of the surface chrome plating layer 6 in which microporouses and microcracks are formed.
Figure 6:
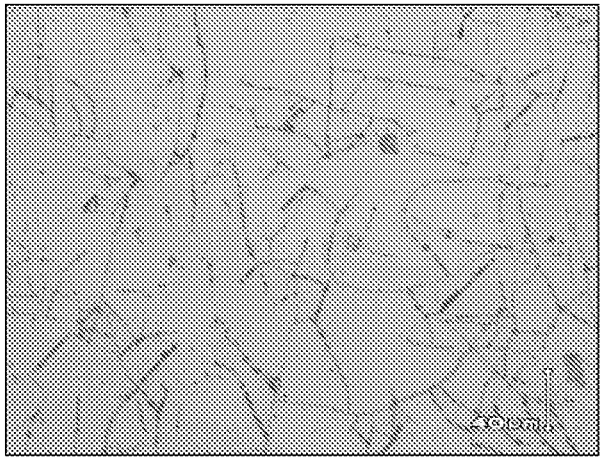
FIG. 6 is a micrograph of the surface chrome plating layer 6 in which microcracks are formed.

FIG. 3 shows a micrograph of the surface chrome plating layer 6 in which the microporouses are formed by plating the corrosion distribution nickel plating layer 5*a* indicated by symbols (P) in Tables 1 to 7. FIG. 4 shows a micrograph of the surface chrome plating layer 6 in which the microcracks are formed by plating the corrosion distribution nickel plating layer 5*a* indicated by symbols (Q) in Tables 1 and 2. FIG. 5 shows a micrograph of the surface chrome plating layer 6 in which the microporouses and the microcracks are formed by plating the corrosion distribution nickel plating layer 5*a* indicated by symbols (R) in Table 2. FIG. 6 shows a micrograph of the surface chrome plating layer 6 in which the microcracks are formed by the characteristic of the surface chrome plating layer 6 itself indicated by symbols (S) in Table 2.

(2) Surface Chrome Plating

In the examples and comparative examples shown in Tables 1 to 6 (with descriptions of "trivalent chromium plating thickness" in the tables or "plating thickness" in the fields of "trivalent chromium plating"), the plating for producing the surface chrome plating layer 6 was carried out in a trivalent chromium plating bath using basic chromium sulfate as the source of chrome. The concentration (g/l) of the basic chromium sulfate in the plating bath is represented by numerals. As for the bath stabilizer, in the examples and comparative examples with (A), the plating was carried out in a plating bath containing ammonium formate as the additive. In the examples and comparative examples with (B), the plating was carried out in a plating bath containing ammonium potassium as the additive. In the examples and comparative examples with (C), the plating was carried out in a plating bath containing ammonium acetate as the additive. The description of each of the examples and comparative examples with (A) to (C) also includes the concentration of the additives.

In Comparative Examples 19 to 22 shown in Table 7, as the surface chrome plating layer 6, the plating with a source of chrome other than the basic chromium sulfate was subjected. In Comparative Examples 19 and 20 in particular, hexavalent chromium plating was performed in a bath containing 300 g/l of chromatic anhydride. In Comparative Examples 21 and 22, trivalent chromium plating was performed in a trivalent chromium bath made of Canning Japan K. K. The actual measurements of thickness of the surface chrome plating layer 6 described above are included in Tables 1 to 7. In each of the examples, the composition of the surface chrome plating layer 6 satisfied the composition of 3 to 19 at % of C, 55 to 95 at % of Cr, 1 to 22 at % of O, and 1 to 7 at % of Fe.

(3) Production of Chromium Compound Film

As for the production of the chromium compound film 7, the examples and comparative examples indicated by symbols (X) in Tables 3 and 6 are different from those indicated by symbols (Y) in terms of the type and conditions of the treatment bath for producing the chromium compound film 7. In the examples and comparative examples indicated by the symbols (X), the chromium compound film 7 was produced by the cathode acidic electrolytic chromating in a bath containing sodium bichromate. On the other hand, in the examples and comparative examples indicated by the symbols (Y), the chromium compound film 7 was produced by the cathode acidic electrolytic chromating in a bath containing 30 g/l of chromate. In the examples and comparative examples indicated by the symbols (Z), the chromium compound film 7 was produced by the cathode acidic electrolytic chromating in a bath containing 135 g/l of sodium bichromate dihydrate. Tables 3 and 6 also include the concentrations of the additives, pH, and temperature of the treatment bath, current density at the treatment operation, treatment time, and the bath temperature in the aforementioned chromium compound film producing process. In each example, the thickness of the chromium compound film 7 was not less than 7 nm.

(4) Test

Each of the test pieces of Examples 1 to 28 and Comparative Examples 1 to 22 was subjected to the corrosion tests 1 and 2.

The corrosion test 1 was carried out according to a loading manner described in "JIS H 8502 CASS test" for a test time of 40 hours.

The corrosion test 2 was carried out as a corrode coat test in a loading manner of uniformly applying a certain amount of a muddy corrosion accelerator including a mixture of 30 g of kaolin and 50 ml of calcium chloride saturated aqueous solution to the surface of each test piece and leaving the product in a constant temperature and humidity chamber maintained at 60° C. and 23% RH (relative humidity) environment. The test time included 11 steps of 4, 8, 16, 24, 48, 96, 120, 168, 336, 504, and 600 hours.

The aforementioned corrosion test 1 was employed in order to determine the resistance to microporous corrosion in the case of applying the decorative chrome-plated part 1 according to the present invention to an automobile exterior part, and the corrosion test 2 was employed to determine the resistance to chrome dissolution corrosion.

All the test pieces of Examples 1 to 28 and Comparative Example 1 to 22 were subjected to specular gloss measurement and exterior appearance observation. The specular gloss measurement was performed with an incident angle of 60 degrees using "micro TRI gloss mu" made of BYK Gardner GmbH. As for the exterior appearance observation, the presence of defective appearances such as uneven tarnish and blots was visually checked as a posttreatment.

The evaluation after the aforementioned corrosion test 1 employed a similar evaluation method similar to a rating number based on the entire corrosion area ratio according to JIS H 8502. The difference from JIS H 8502 is a way of handling fine corrosion spots. In JIS H 8502, the evaluation is performed for corrosion spots except corrosion spots with a size of not more than 0.1 mm (100 micrometers). However, in the light of the real increase in users' performance requirements for automobile exterior (decorative) parts in recent years, the size of the corrosion spots not evaluated was set to not more than 30 micrometers in the evaluation of the corrosion test 1. Accordingly, corrosion spots with a size of 30 to 100 micrometers, which were not evaluated in the JIS H 8502, were included in the evaluation, so that the evaluation for the corrosion test 1 of Table 1 was stricter than that based on the JIS H8502. The maximum rating of the corrosion test 1 was 10.0, and a larger number of the rating denotes a smaller corrosion area and higher corrosion resistance. The results shown in Tables 1 to 7 were evaluated by the aforementioned test and evaluation methods using four grades: AAA—test pieces having a rating number of 9.8 or more; AA—test pieces having a rating number of 9.0 or more and less than 9.8; A—test pieces having a rating number of 8.0 or more and less than 9.0; and NG—test pieces having a rating number of less than 8.0.

At the evaluation after the aforementioned corrosion test 2 was executed, time from when the applied mud was removed by flowing water or the like so as not to damage the surface of the test piece and was dried to when occurrence of visually identifiable white tarnish or interference color (the starting point of occurrence of chrome dissolving corrosion) were identified was measured. It is meant that the test piece whose measured time is longer has a higher resistance to chrome dissolving corrosion. The results shown in Tables 1 to 7 were evaluated by the aforementioned test and evaluation methods using four grades: NG—test pieces whose changes in appearance such as white tarnish, inference color, and dissolution of the chrome layers were observed within 4 hours; B—test pieces in which the above changes in appearance were observed at 8, 16, 24, 48, 96, 120 or 168 hours; A—test pieces in which the above changes in appearance were observed at 336, 504 or 600 hours; and AA—test pieces in which no changes in appearance were observed after 600 hours.

The aforementioned evaluations of the mirror gloss and exterior appearance were carried out by the aforementioned test and evaluation methods which could relatively clearly classify differences in design of the decorative chromium plating for automobile exterior parts. The results shown in Tables 1 to 7 were evaluated using three grades: AA—test pieces with a specular gloss of 530 or more; A—test pieces with a specular gloss of 480 or more; and NG—test pieces with a specular gloss of less than 480 or test pieces including appearance defects such as brown tarnish in the surfaces of the test pieces.

TABLE 1

| EXAMPLE | PLATING FOR CORROSION CURRENT DISTRIBUTION TYPE | TRIVALENT CHROMIUM PLATING THICKNESS (μm) | CHROMIUM COMPOUND PRODUCTION | CORROSION TEST 1 CASS TEST | CORROSION TEST 2 CALCIUM CHLORIDE MUD TEST | SPECULAR GLOSS & EXTERIOR APPEARANCE |
|---|---|---|---|---|---|---|
| 1 | (P) | 0.17 | EXAMPLE 16 | AA | AA | A |
| 2 | (Q) | 0.27 | EXAMPLE 16 | A | AA | A |
| 3 | (Q) | 2.11 | EXAMPLE 16 | A | AA | A |
| 4 | (R) | 0.25 | EXAMPLE 16 | AAA | AA | A |
| 5 | (S) | 1.51 | EXAMPLE 16 | A | AA | A |

The conditions of the trivalent chromium plating bath are the same as those of Examples 6 to 8. The conditions of chromium compound production are the same as those of Example 16.

TABLE 2

| | | TRIVALENT CHROMIUM PLATING | | | | | | | | |
|---|---|---|---|---|---|---|---|---|---|---|
| | | | | | BATH STABILIZER | | | | | |
| EXAMPLE | CORROSION CURRENT DISTRIBUTION PLATING | PLATING THICKNESS (μm) | BASIC CHROMIUM SULFATE CONCENTRATION (g/l) | CURRENT DENSITY (A/dm$^2$) | TYPE | CONCENTRATION (g/l) | CHROMIUM COMPOUND PRODUCTION | CORROSION TEST 1 (CASS TEST) | CORROSION TEST 2 (CALCIUM CHLORIDE MUD TEST) | SPECULAR GLOSS & EXTERIOR APPEARANCE |
| 6 | (P) | 0.05 | 130 | 10 | (A) | 40 | EXAMPLE 16 | A | A | A |
| 7 | (P) | 0.15 | 130 | 10 | (A) | 40 | EXAMPLE 16 | AA | AA | A |
| 8 | (P) | 0.47 | 130 | 10 | (A) | 40 | EXAMPLE 16 | AA | AA | A |
| 9 | (P) | 0.60 | 160 | 10 | (A) | 55 | EXAMPLE 16 | A | A | A |
| 10 | (P) | 0.12 | 130 | 6 | (A) | 40 | EXAMPLE 16 | A | A | A |
| 11 | (P) | 0.12 | 90 | 10 | (A) | 40 | EXAMPLE 16 | A | AA | A |
| 12 | (Q) | 2.51 | 160 | 17 | (A) | 55 | EXAMPLE 16 | A | A | A |
| 13 | (P) | 0.25 | 130 | 10 | (B) | 55 | EXAMPLE 16 | AA | A | AA |
| 14 | (P) | 0.20 | 130 | 10 | (C) | 50 | EXAMPLE 16 | AA | A | A |

The conditions of chromium compound production are the same as those of Example 16.

TABLE 3

| | | | CHROMIUM COMPOUND | | | | | | | | |
|---|---|---|---|---|---|---|---|---|---|---|---|
| | | | TREATMENT BATH CONDITION | | | TREATMENT OPERATIONAL CONDITION | | | | | |
| EXAMPLE | CORROSION CURRENT DISTRIBUTION PLATING | TRIVALENT CHROMIUM PLATING THICKNESS (μm) | TYPE | CONCENTRATION (g/l) | pH | CURRENT DENSITY (A/dm$^2$) | TREATMENT TIME (sec) | TEMPERATURE (° C.) | CORROSION TEST 1 (CASS TEST) | CORROSION TEST 2 (CALCIUM CHLORIDE MUD TEST) | SPECULAR GLOSS & EXTERIOR APPEARANCE |
| 15 | (P) | 0.23 | (X) | 27 | 4.0 | 0.5 | 30 | 35 | AA | AA | A |
| 16 | (P) | 0.26 | (X) | 27 | 4.7 | 0.5 | 30 | 35 | AA | AA | A |
| 17 | (P) | 0.16 | (X) | 27 | 5.0 | 0.5 | 30 | 35 | AA | AA | A |
| 18 | (P) | 0.19 | (Y) | 30 | 1.0 | 0.5 | 30 | 35 | A | A | A |
| 19 | (P) | 0.25 | (X) | 20 | 4.7 | 0.5 | 30 | 35 | A | A | A |
| 20 | (P) | 0.23 | (X) | 40 | 4.7 | 0.5 | 30 | 35 | AA | AA | A |
| 21 | (P) | 0.17 | (X) | 27 | 1.0 | 0.5 | 30 | 35 | AA | AA | A |
| 22 | (P) | 0.29 | (X) | 27 | 5.5 | 0.5 | 30 | 35 | A | A | A |
| 23 | (P) | 0.20 | (X) | 27 | 4.7 | 0.1 | 30 | 35 | A | A | A |
| 24 | (P) | 0.23 | (X) | 27 | 4.7 | 1 | 30 | 35 | A | AA | A |
| 25 | (P) | 0.17 | (X) | 27 | 4.7 | 0.5 | 10 | 35 | A | A | A |

TABLE 3-continued

| EXAMPLE | CORROSION CURRENT DISTRIBUTION PLATING | TRIVALENT CHROMIUM PLATING THICKNESS (μm) | CHROMIUM COMPOUND TREATMENT BATH CONDITION TYPE | CONCENTRATION (g/l) | pH | TREATMENT OPERATIONAL CONDITION CURRENT DENSITY (A/dm$^2$) | TREATMENT TIME (sec) | TEMPERATURE (° C.) | CORROSION TEST 1 (CASS TEST) | CORROSION TEST 2 (CALCIUM CHLORIDE MUD TEST) | SPECULAR GLOSS & EXTERIOR APPEARANCE |
|---|---|---|---|---|---|---|---|---|---|---|---|
| 26 | (P) | 0.15 | (X) | 27 | 4.7 | 0.5 | 90 | 35 | A | AA | A |
| 27 | (P) | 0.22 | (X) | 27 | 4.7 | 0.5 | 30 | 20 | A | A | A |
| 28 | (P) | 0.21 | (X) | 27 | 4.7 | 0.5 | 30 | 70 | A | A | A |

The bath conditions of trivalent chromium plating are the same as those of Examples 6 to 8.

TABLE 4

| COMPARATIVE EXAMPLE | PLATING FOR CORROSION CURRENT DISTRIBUTION TYPE | TRIVALENT CHROMIUM PLATING THICKNESS (μm) | CHROMIUM COMPOUND PRODUCTION | CORROSION TEST 1 (CASS TEST) | CORROSION TEST 2 (CALCIUM CHLORIDE MUD TEST) | SPECULAR GLOSS & EXTERIOR APPEARANCE |
|---|---|---|---|---|---|---|
| 1 | NOT EXECUTED | 0.13 | EXAMPLE 16 | NG | NG | A |
| 2 | NOT EXECUTED | 0.71 | EXAMPLE 16 | NG | B | A |

The conditions of the trivalent chromium plating bath are the same as those of Examples 6 to 8. The conditions of chromium compound production are the same as those of Example 16.

TABLE 5

| COMPARATIVE EXAMPLE | CORROSION CURRENT DISTRIBUTION PLATING | TRIVALENT CHROMIUM PLATING THICKNESS (μm) | BASIC CHROMIUM SULFATE CONCENTRATION (g/l) | CURRENT DENSITY (A/dm$^2$) | BATH STABILIZER TYPE | BATH STABILIZER CONCENTRATION (g/l) | CHROMIUM COMPOUND PRODUCTION | CORROSION TEST 1 (CASS TEST) | CORROSION TEST 2 (CALCIUM CHLORIDE MUD TEST) | SPECULAR GLOSS & EXTERIOR APPEARANCE |
|---|---|---|---|---|---|---|---|---|---|---|
| 3 | (P) | 0.04 | 90 | 5 | (A) | 40 | EXAMPLE 16 | NG | NG | NG |
| 4 | (P) | 0.17 | 90 | 10 | (A) | 15 | EXAMPLE 16 | NG | NG | NG |
| 5 | (P) | 0.15 | 180 | 10 | (C) | 50 | EXAMPLE 16 | A | A | NG |
| 6 | (P) | 0.11 | 80 | 10 | (B) | 55 | EXAMPLE 16 | NG | NG | AA |

The conditions of chromium compound production are the same as those of Example 16.

TABLE 6

| COMPARATIVE EXAMPLE | CORROSION CURRENT DISTRIBUTION PLATING | TRIVALENT CHROMIUM PLATING THICKNESS (μm) | CHROMIUM COMPOUND TREATMENT BATH CONDITION TYPE | CONCENTRATION (g/l) | pH | TREATMENT OPERATIONAL CONDITION CURRENT DENSITY (A/dm$^2$) | TREATMENT TIME (sec) | TEMPERATURE (° C.) | CORROSION TEST 1 (CASS TEST) | CORROSION TEST 2 (CALCIUM CHLORIDE MUD TEST) | SPECULAR GLOSS & EXTERIOR APPEARANCE |
|---|---|---|---|---|---|---|---|---|---|---|---|
| 7 | NONE | 0.27 | NOT EXECUTED | | | | | | NG | NG | A |
| 8 | NONE | 0.23 | (X) | 27 | 4.7 | 0.5 | 30 | 35 | NG | B | A |
| 9 | NONE | 0.16 | (Z) | 135 | 12 | 2.0 | 30 | 35 | NG | NG | A |
| 10 | (P) | 0.20 | NOT EXECUTED | | | | | | NG | NG | A |
| 11 | (P) | 0.22 | (X) | 15 | 4.7 | 0.5 | 30 | 35 | NG | A | A |
| 12 | (P) | 0.16 | (X) | 50 | 4.7 | 0.5 | 30 | 35 | NG | A | NG |
| 13 | (P) | 0.15 | (Y) | 10 | 1.0 | 0.5 | 30 | 35 | NG | B | A |
| 14 | (P) | 0.20 | (X) | 27 | 6.0 | 0.5 | 30 | 35 | NG | B | A |
| 15 | (P) | 0.25 | (X) | 27 | 4.7 | 1.3 | 30 | 35 | A | AA | NG |
| 16 | (P) | 0.15 | (X) | 27 | 4.7 | 0.5 | 100 | 35 | NG | A | A |

TABLE 6-continued

| COMPARATIVE EXAMPLE | CORROSION CURRENT DISTRIBUTION PLATING | TRIVALENT CHROMIUM PLATING THICKNESS (μm) | CHROMIUM COMPOUND: TREATMENT BATH CONDITION TYPE | CONCENTRATION (g/l) | pH | TREATMENT OPERATIONAL CONDITION: CURRENT DENSITY (A/dm$^2$) | TREATMENT TIME (sec) | TEMPERATURE (° C.) | CORROSION TEST 1 (CASS TEST) | CORROSION TEST 2 (CALCIUM CHLORIDE MUD TEST) | SPECULAR GLOSS & EXTERIOR APPEARANCE |
|---|---|---|---|---|---|---|---|---|---|---|---|
| 17 | (P) | 0.18 | (X) | 27 | 4.7 | 0.5 | 30 | 10 | NG | A | A |
| 18 | (P) | 0.24 | (Z) | 135 | 12 | 2.0 | 30 | 35 | NG | A | A |

The bath conditions of trivalent chromium plating are the same as those of Examples 6 to 8.

TABLE 7

| COMPARATIVE EXAMPLE | CORROSION CURRENT DISTRIBUTION PLATING | CHROMIUM PLATING MEANS: PLATING TYPE | PLATING THICKNESS (μm) | CHROMIUM COMPOUND PRODUCTION | CORROSION TEST 1 (CASS TEST) | CORROSION TEST 2 (CALCIUM CHLORIDE MUD TEST) | SPECULAR GLOSS & EXTERIOR APPEARANCE |
|---|---|---|---|---|---|---|---|
| 19 | (P) | HEXAVALENT CHROMIUM | 0.23 | NOT EXECUTED | AA | NG | REFERENCE |
| 20 | (P) | HEXAVALENT CHROMIUM | 0.27 | EXAMPLE 16 | AA | NG | AA |
| 21 | (P) | ENVIRO-CHROME | 0.36 | EXAMPLE 16 | A | NG | AA |
| 22 | (P) | TWILIGHT | 0.16 | EXAMPLE 16 | NG | AA | NG |

As apparent from Tables 1 to 3, as for Examples 1 to 28, all of the results of the aforementioned evaluations of the corrosion tests 1 and 2, specular gloss, and exterior appearance were AAA, AA, or A. It is therefore understood that Examples 1 to 28 are excellent in corrosion resistance and design. On the other hand, as for Comparative Examples 1 to 22 of Tables 4 to 7, many results of the evaluations of the corrosion tests 1 and 2, specular gloss, and exterior appearance were NG or B, and there is no test piece whose all the three types of evaluations are AAA, AA, or A. It is therefore revealed that Comparative Examples 1 to 22 are inferior to above Examples 1 to 28 in terms of the corrosion resistance and design.

Hereinabove, the embodiment to which the present invention made by the Inventors is applied is explained. The present invention is not limited by the description and drawings constituting a part of the disclosure of the present invention by the embodiment. It is obvious that all other embodiments, examples, operational techniques, and the like implemented by those skilled in the art based on the aforementioned embodiment are included within a range of the present invention.

INDUSTRIAL APPLICABILITY

This invention can be applied to the chrome-plated part.

The invention claimed is:

1. A method of manufacturing a chrome-plated part, comprising:

forming a corrosion distribution plating layer configured for corrosion current distribution; a bright nickel plating layer; and a non-sulfur nickel plating layer over a body, wherein the bright nickel plating layer is provided between the corrosion distribution plating layer and the non-sulfur nickel plating layer, and the non-sulfur nickel plating layer is more noble potential than the bright nickel plating layer;

forming a 0.05 to 2.5 micrometers thick trivalent chromium plating layer on the corrosion distribution plating layer using basic chromium sulfate as a metal source, the trivalent chromium plating layer having a composition comprising 3 to 19 at % of C, 55 to 95 at % of Cr, 1 to 22 at % of O, and 1 to 7 at % of Fe and having 5000/cm$^2$ or more of micropores;

forming a not less than 7 nm thick chromium compound film on the trivalent chromium plating layer by cathode acidic electrolytic chromating, wherein the cathode acidic electrolytic chromating is performed at a current density of 0.1 to 1.0 A/dm$^2$ for 10 to 90 seconds in a bath containing at least 20 to 40 g/l of any one of chromate and chromic anhydride and having a pH of 1.0 to 5.5 and a temperature of 20 to 70° C., and wherein forming the corrosion distribution plating layer is carried out in a microporous nickel plating bath so that the 5000/cm$^2$ or more of micropores are produced in the trivalent chromium plating layer.

2. The method of manufacturing a chrome-plated part according to claim 1, wherein the trivalent chromium plating layer is formed by electroplating in a plating bath containing 90 to 160 g/l of basic chromium sulfate as a main component and containing as additives: at least any one of thiocyanate, monocarboxylate, and dicarboxylate; at least any one of ammonium salt, alkali metal salt, and alkali earth metal salt; a boron compound; and bromide.

3. The method of manufacturing a chrome-plated part according to claim 2, wherein the trivalent chromium plating layer is formed by the electroplating in the plating bath containing as the additives: at least any one of ammonium formate and potassium formate as the monocarboxylate, at least any one of ammonium bromide and potassium bromide as the bromide; and boric acid as the boron compound.

4. The method of manufacturing a chrome-plated part according to claim 1, wherein the cathode acidic electrolytic chromating is a treatment forming the not less than 7 nm thick chromium compound film of at least any one of chrome oxide, hydroxide, and oxyhydroxide.

5. The method of manufacturing a chrome-plated part according to claim 1, wherein the cathode acidic electrolytic chromating is performed at a current density of 0.1 to 1.0 $A/dm^2$ for 10 to 90 seconds in a bath containing 20 to 40 g/l of any one of chromate and chromic anhydride and having a pH of 1.0 to 5.5 and a temperature of 20 to 70° C.

6. The method of manufacturing a chrome-plated part according to claim 1, wherein the cathode acidic electrolytic chromating is performed at a current density of 0.1 to 1.0 $A/dm^2$ for 10 to 90 seconds in a bath containing at least 20 to 40 g/l of chromic anhydride and having a pH of 1.0 to 5.5 and a temperature of 20 to 70° C.

7. The method of manufacturing a chrome-plated part according to claim 1, wherein the cathode acidic electrolytic chromating is performed at a current density of 0.1 to 1.0 $A/dm^2$ for 10 to 90 seconds in a bath containing 20 to 40 g/l of chromic anhydride and having a pH of 1.0 to 5.5 and a temperature of 20 to 70° C.

* * * * *